United States Patent [19]

Dixon et al.

[11] Patent Number: 4,968,447

[45] Date of Patent: Nov. 6, 1990

[54] CLEANING COMPOSITION AND METHOD

[75] Inventors: Donald R. Dixon, Hartland; Jeffrey W. Maxwell, Pontiac, both of Mich.

[73] Assignee: Gage Products Company, Ferdale, Mich.

[21] Appl. No.: 231,051

[22] Filed: Aug. 11, 1988

[51] Int. Cl.[5] ..... C11D 7/22

[52] U.S. Cl. ..... 252/174.23; 134/6; 134/7; 134/8; 252/130; 252/163

[58] Field of Search ..... 134/6, 7, 8; 252/130, 252/174.23, 163

[56] References Cited

U.S. PATENT DOCUMENTS 4,481,126 11/1984 Trinh et al. ..... 134/7
4,655,957 4/1987 Chromecek et al. ..... 252/130
4,670,060 6/1987 Su et al. ..... 252/174.23
4,731,125 3/1988 Carr ..... 134/38
4,855,067 8/1989 Jakubicki ..... 252/174.23

*Primary Examiner*—Asok Pal
*Attorney, Agent, or Firm*—Krass & Young

[57] ABSTRACT

A cleaning composition includes a liquid vehicle having dispersed therein, a particulate, organic, polymeric material. This composition is used for cleaning encrustations from the interior surface of tubes or other vessels, particularly those of paint delivery systems. Such cleaning is accomplished by maintaining a flow of the cleaning composition through the vessel. The vehicle may comprise organic or inorganic solvent mixtures and may include detergents, surfactants and similar ancillary ingredients.

10 Claims, No Drawings

CLEANING COMPOSITION AND METHOD

FIELD OF THE INVENTION

This invention relates generally to methods and compositions for cleaning and in particular to the cleaning of deposits from the interior of tubes, tanks, conduits and the like. Most specifically, the present invention relates to a process and composition for cleaning encrustations from the lines of paint systems utilizing a particulate containing composition.

BACKGROUND OF THE INVENTION

Presently, the paint delivery systems which are utilized for the finishing of a wide variety of manufactured items such as motor vehicles, household appliances and the like are becoming increasingly more sophisticated. A typical industrial paint delivery system may comprise a central paint supply having a number of painting stations communicating therewith. Such paint delivery systems can selectably deliver a variety of different paints to a given painting station and include complex fluid pathways involving various tanks, pumps and conduits. These paint delivery systems tend to become clogged with encrustations in the course of their use and such deposits can decrease and even block the flow of paint therethrough. Such clogging is occasioned by deposits of pigment, resins or other components of the paint within the tanks and lines of the system. In addition to causing clogging, such deposits can also contaminate the paint color, and can cause surface defects in the finished, painted product. Cleaning the paint delivery system reduces the amount of surface repairs to paint finishes.

The build-up of residues necessitates periodic cleaning of paint delivery systems and because of the complexity of the systems and the necessity of avoiding expensive downtime, it is generally preferable that such systems be cleaned without disassembly. The prior art approach to cleaning involves passing a variety of solvents, detergents or other cleaners through the system, and tends to involve numerous steps and multiple compositions. It should be noted that these processes often do not provide full removal of deposits, particularly pigment residues.

A typical prior art process can involve flushing five or more different cleaning compounds of varying polarity through the paint system and can include 30 separate operational steps. The numerous cleaning compounds are needed in order to fully remove the residues in the system and to ensure compatibility of any cleaner residue remaining in the system with subsequently introduced paint. As a result, the system must be sequentially rinsed with various materials in a predetermined order such that the final rinse is with a paint-compatible thinner. Clearly, it would be most advantageous to reduce the number of steps by utilizing a cleaning composition which is, fully paint-compatible and to improve the efficiency of the process by utilizing a composition capable of removing all residues.

Many prior art cleaning compositions also present problems of waste disposal. The cleaning compositions may be broadly categorized as either organic based or aqueous based. The organic based materials can employ halogenated and/or aromatic solvents as well as reagents such as acetone, methyl ethyl ketone, and the like. These solvents are toxic, and in many instances flammable and present problems cf disposal as well as compatibility with the components of the pain: delivery system. The aqueous solvents generally comprise highly caustic materials such as potassium hydroxide or sodium hydroxide or acidic materials such as acetic acid, all of which present dangers in both handling and disposal. Many of the aforementioned solvents, particularly the aqueous based ones, are not compatible with subsequently utilized paint and hence elaborate rinse procedures are needed before the cleaned equipment may be put back into service. In addition to the foregoing shortcomings, prior art paint system cleaning solvents do not provide sufficient cleaning action, particularly with regard to encrusted pigment deposits and, as a consequence, long flush times and/or repeated cleaning cycles have been generally required.

It has been known to utilize abrasive materials to clean closed lines and one such process is disclosed in U.S. Pat. No. 4,572,744 which describes the use of sand or similar material entrained in a flow of air to clean the interior of boiler tubes. Also mentioned in the '744 patent is the similar use of liquid based abrasive slurries to clean pipes.

Heretofore, various attempts have been made to utilize abrasive based materials for cleaning paint lines and it is known to employ mica, or sand particles in conjunction with a flush liquid to scour the interior of paint lines. Problems have arisen with the use of such inorganic abrasives insofar as they can be relatively hard and tend to damage or clog pumps and passageways through which they flow. Additionally, such inorganic abrasive materials are also relatively dense and tend to settle out of a cleaning fluid unless vigorous agitation is maintained or thickeners are added to increase the solution viscosity.

It is known to utilize a specific paint system cleaning composition comprised of sand or mica suspended in a solution of xylene and methyl isobutyl ketone thickened with a resinous material. Compositions of this type present problems insofar as the resin and abrasive are difficult to rinse from the system thereby presenting problems of contamination, particularly when the resin is not compatible with subsequently employed paint compositions; additionally, the viscous composition presents problems of waste disposal insofar as the resin is difficult to incinerate and inhibits the ready evaporation and recovery of the xylene and ketone. Obviously, the inorganic abrasive residue presents significant waste disposal problems insofar as it cannot be readily incinerated.

The present invention overcomes various shortcomings of prior art cleaning compositions and methods insofar as it provides a group of simple to use compositions which are readily compatible with a variety of paint formulations and which can be readily incinerated or recycled.

The cleaning compositions of the present invention include a particulate organic abrasive material. Organic, polymeric materials are not generally thought of as being abrasive; however the present invention relies in part upon the counter intuitive finding that organic materials can function very well to facilitate the cleaning of encrustations from paint delivery systems. The polymeric particles utilized in this invention are of relatively low density and hence may be maintained in suspension without resort to thickeners or vigorous agitation. Although these organic materials perform an excellent job of cleaning residues from paint lines, they are not sufficiently abrasive to damage pumps, valves and the like. The compositions of the present invention may be advantageously utilized in cleaning the lines and tanks of paint delivery systems as well as for other cleaning purposes where some degree of abrasive action is required. The relatively low viscosity of the cleaning compositions of the present invention simplifies their disposal or recycling and the fact that they contain no inorganic solids allows for their ready incineration. These and other advantages of the present invention will be readily apparent from the drawings, discussion, description and claims which follow.

SUMMARY OF THE INVENTION

There is disclosed herein a method for cleaning encrustations from the interior surface of a vessel. The method includes the steps of providing a cleaning composition comprising a vehicle having a particulate, organic, polymeric material dispersed therein and establishing and maintaining a flow of the cleaning composition through the vessel. The particulate material may in some instances be selected from the group consisting essentially of: polypropylene, polyvinylchloride, polyethylene, polytetrafluoroethylene, copolymers thereof, and mixtures thereof. In particular instances, the particulate material is of a particle size no greater than one half inch, although in some instances a particle size of no more than 200 microns is desired and in yet other instances a particle size range of approximately 50–150 microns is preferred for the organic material. In yet other instances, it is preferred that the specific gravity of the material be less than 1.5.

The vehicle may comprise a liquid including therein an organic solvent and this solvent may be selected from the group consisting essentially of: aliphatic hydrocarbons, aromatic hydrocarbons, lactones, lactams, terpenes, alcohols, organic acids, amines, amides, ketones, aldehydes, esters, halocarbons, ethers, glycols and combinations thereof. In other instances the liquid vehicle may include water whereas in yet other instances the vehicle may be acidic or alkaline. The composition may further include ancillary ingredients such as detergents, surfactants, or thickeners.

In general it will be preferred that the particulate matter comprise between 2 and 20 volume percent of the composition although particular applications may require greater or lesser amounts. In implementing the process, a flow of the cleaning composition may be established through the vessel by pumping the material therethrough. In those instances where the vessel is a tube it may be advantageous to maintain a linear flow of at least 50 feet per minute therethrough. Also included within the scope of the instant invention is the aforementioned composition.

DETAILED DESCRIPTION OF THE INVENTION

The present invention recognizes the fact that inclusion of a particulate, organic, polymeric material in a cleaning composition improves the ability of that composition to remove encrusted deposits from the interior surfaces of vessels such as tanks and tubes. This finding is counterintuitive in the sense that the polymeric materials tend to be relatively soft compared to the components of the encrustations which they remove. As was mentioned previously, heretofore employed compositions relied upon the use of extremely hard abrasive materials which were difficult to use and caused damage to equipment.

The composition of the present invention includes in its simplest form a vehicle, which is preferably a solvent for at least some components of the encrustations, and the aforementioned polymeric material. The vehicle may be organic or inorganic depending upon the particular cleaning task. Among the organic materials which may be used are solvent such as aliphatic hydrocarbons, aromatic hydrocarbons, lactones such as butyrolactone, lactams, particularly pyrrolidones, terpenes, alcohols, organic acids, amines, amides, ketones, aldehydes, esters, halogenated solvents, ethers, glycols and the like either taken singly or in combination. Some particular solvents include xylene, propylene carbonate, m-pryol and the like. Inorganic vehicles will generally be aqueous based and can be acidic or alkaline. Either the organic or inorganic vehicles can include detergents, surfactants, and other such ancillary ingredients as is well known to those of skill in the art. In some instances it may be advantageous to blend organic and aqueous solvents. The basic requirement of a vehicle is that it be inert to the organic particulate material.

From the foregoing it should be apparent that there are a wide variety of solvents which may be employed in the present invention. The principal requirements for solvent selection are that the solvent not dissolve the organic, polymeric particulate material and that it not damage the system being cleaned. Within these bounds one can readily select a variety of solvent materials.

The organic particulate material may comprise any one of a number of polymeric materials provided that such materials do not dissolve in the vehicle and do not melt, decompose or otherwise react at the cleaning temperature. Among some polymeric materials which were found to have significant utility are polypropylene, polyethylene, polyvinylchloride, and halogenated polymers such as polytetrafluoroethylene. The size of polymer particles utilized will depend upon the particular application however it has generally been found that larger particles provide for a more rapid cleaning action as compared to smaller particles. However it should be kept in mind that as the particles get larger it becomes more difficult to maintain them in a dispersed form in the vehicle and very large particles tend to clog pumps, lines and the like. Although the present invention is not limited to any particular size of particles, as a general rule it has been found that for systems using reciprocating or impeller type pumps particle sizes of 200 microns or less generally function the best and that particles within a size range of 50–150 microns are usually the most preferred. It should be noted however, that many new paint delivery systems employ diaphragm type pumps, and that pumps of this type are less prone to clogging of the particles than are heretofore employed pumps. Consequently, in a diaphragm pumped system, relatively large particles of polymeric material (i.e., as large as ½ inch diameter) may be employed. The fact that polymeric materials of the type employed herein are of relatively low density (typically no greater than 1.5) helps to prevent them from settling out even if they are large.

There are a number of suppliers of particulate polymeric material which may be used herein. Hercules, Inc. of Bloomington, Del. supplies particulate polypropylene under the trade name of "Hercoflat" ®. This material is very stable over a wide temperature range and in a variety of solvents. It has a specific gravity of approximately 0.9, which facilitates its suspension in a variety of solvents. Hercoflat ® grade 1200 has a mean average particle size, of 200 microns, whereas grade 1150 has a particle size of approximately 150 microns. In some instances it has been found advantageous to utilize Hercoflat ® grade 135 which has a mean particle size of approximately 35 microns.

A similar polypropylene material is sold by Micro Powders, Inc. of Scarsdale, N.Y. under the trade name Propyl-Tex 140 and comprises polypropylene having a particle size of approximately 50–55 microns. Shamrock Technologies of Newark, N.J. sells polypropylene powders having particle sizes ranging from 18 to 90 microns under the trade name "Texture Series," and these materials are suitable for the present invention. The Allied Corporation of Norristown, N.J. sells a polyethylene particulate material under the trade name of "A-C" ® 316A polyethylene. This material comprises 40 mesh polyethylene having a density of approximately 0.98 G/CC. The B.F. Goodrich Chemical Group of Cleveland, Ohio provides a variety of polyvinylchloride materials under the trade name "Geon" ®. These materials are quite inert and have a specific gravity of approximately 1.4 and are available in a variety of particle sizes. Of particular advantage is Grade 141 which comprises approximately 100 micron size particles and Grade 142 which comprises particles of approximately 75–80 microns in size. In addition to the foregoing, there are a wide variety of other polymers and other suppliers which are known to one of skill in the art who could readily locate such sources of supply, and in light of the teaching herein, obtain material useful in the practice of the present invention.

Use of a polymeric "abrasive" material confers particular advantage in a cleaning process. The polymeric materials generally have a low adhesion to metallic parts such as components of a paint delivery system thereby minimizing rinse steps in the cleaning process and reducing contamination of subsequently painted articles. Such contamination is a particular problem in the use of inorganic abrasive materials, many of which, such as mica or silica sand, have a high affinity for metallic surfaces. The relatively low density of the polymeric material prevents it from settling out thereby allowing the composition to be shipped, stored and utilized without numerous mixing steps. Most organic polymers useful in the present invention have a specific gravity of 1.5 or less and many have a specific gravity below one whereas most of the commonly employed inorganic abrasive materials have specific gravities greater than 2.5. Because of the fact that the particulate material of the present invention remains in suspension readily, the need for resins or other thickening materials is eliminated thereby resulting in a savings of cost and facilitating waste disposal and solvent recovery in addition to preventing contamination of subsequently applied paint by the resin. Elimination of resins and/or thickeners results in a cleaner of low viscosity. Such low viscosity material is easy to pump through the system and is capable of reaching and cleaning narrow passages in the system. It has been found that typical compositions of the present invention have a viscosity comparable to water. Times for discharge of a standard #4 Ford viscosity measuring cup are approximately 10 seconds. As mentioned previously, the organic polymeric materials of the present invention are completely incineratable whereas the inorganic materials are not. A final point to be noted is that the organic polymeric materials are relatively soft and therefore do not abrade or damage pumps or other equipment through which they pass.

As mentioned previously, there are a variety of compositions which may be formulated in accord with the teaching of the present invention. Presented herein for purposes of illustration and not limitation are some particular formulations which have been found to be advantageous in cleaning lines of paint delivery systems.

EXAMPLE 1

This composition comprises approximately 48.5% xylene, 17.2% dibasic ester, a paint solvent sold by the DuPont Corporation of Wilmington, Del.; approximately 24% isobutyl isobutyrate, an ester solvent for paint and approximately 9.3% Hercoflat ® 1150 polypropylene powder. The foregoing ingredients were mixed together by simple agitation and were employed as will be described hereinbelow in a cleaning process.

EXAMPLE 2

This composition was for a line cleaner having a higher flash point than that of Example 1, consequently the xylene was replaced with a high flash point aromatic solvent sold under the trade name Cyclosol 53 by Shell Chemical which is a subsidiary of The Shell Oil Company of Houston, Tex.

EXAMPLE 3

This example relates to a composition having a higher volatility than the foregoing and is comprised of approximately 30.2% methyl isobutyl ketone; 30.2% xylene; 30.2% of the aforementioned dibasic ester solvent and approximately 9.4% Hercoflat ® 1150 polypropylene.

EXAMPLE 4

This example relates to a water compatible cleaning composition comprised of approximately 49% water; 29% 2-Butanol; 9.8% methyl ethyl ketone; 9.8% Hercoflat 1150 polypropylene powder; 0.2% choline base (45%), an organic, industrial alkali; approximately 2% of Polytergent B-300; a nonylphenol detergent sold by the Olin Corporation of Stanford, Conn.

EXAMPLE 5

This example employed a 35 micron particle size polymeric material. The composition consisted of 30.4% of the aforementioned dibasic ester solvent; 30.4% of methyl isobutyl ketone; 30.4% of xylene and 8% of Hercoflat ® 1135 polypropylene powder.

All of the aforementioned compositions were fabricated and tested under similar conditions by pumping them through glass tubes which had been coated with paint residue upon the interior surface thereof. The compositions were pumped at room temperature and a flow rate of 50 ft/min. Visual inspection of the tubes indicated that all of the aforementioned compositions. were quite satisfactory in effecting cleaning thereof. The composition of Example 1 was the very best with the remaining compositions being of slightly decreasing efficiency.

In the following series of examples, the effect of varying the amount of organic particulate material was assessed. Various cleaning compositions were prepared as follows:

EXAMPLE 6

This sample comprised N-methylpyrrolidone 25%; cyclohexanone 7%; Cyclosol 53, as previously described 18%; triethanolamine (85%) 3%; diacetone alcohol 9%; polytergent B-300, as previously described 1.5%; dibasic ester, as previously described 16.5% and propylene glycol monomethyl ether, a solvent provided by the Olin Corporation of Stanford, Conn., 16.5%. It should be noted that no organic particulate was included.

EXAMPLE 7

This sample comprised n-methylpyrrolidone 22.7%; cyclohexanone 6.3%; Cyclosol 53 16.3%; triethanolamine (85%) 2.7%; diaceatone alcohol 8.2%; polytergent B-300 1.3%; dibasic ester 18%; propylene glycol monomethyl ether, 14.9% and Hercoflat ® 1150 9.3%.

EXAMPLE 8

This sample comprised n-methylpyrrolidone 21;2%; cyclohexanone 5.9%; Cyclosol 53 15.3%; triethanolamine (85%) 2.5%; diaceatone alcohol 7.6%; polytergent B-300 1.3%; dibasic ester 17%; propylene glycol monomethyl ether 14% and Hercoflat ® 1150 15%.

EXAMPLE 9

This composition consisted of n-methylpyrrolidone 19.9%; cyclohexanone 5.6%; Cyclosol 53 14.4%; triethanolamine (85%) 2.4%; diaceatone alcohol 7.1%; polytergent B-300 1.2%; dibasic ester 15.9%; propylene glycol monomethyl ether 13.2% and Hercoflat ® 11.50 20.1%.

In evaluating the foregoing four samples it was found that the material of Sample 6, lacking the polymeric material was the poorest cleaning agent and that the cleaning efficiencies of the compositions increased as the level of polymeric material increased. It was also noted that the composition of Example 9 began to show some pumping problems owing to the heavy polymer loading; although as noted hereinabove, use of other pumps, such as diaphragm pumps will permit use of particulate material of large size and heavy loading.

In general it will be appreciated from the foregoing that a wide variety of solvent materials may be employed in the use of the present invention and that significant advantage in cleaning ability attends upon the use of the organic, polymeric material. The upper limit of the percent of polymeric material in the vehicle is established by flow conditions of the liquid through a given system and that upper limit will depend inter alia upon system conditions as well as the particular solvents employed. Generally, 2–20% polymer will provide good cleaning action. It will also be noted that similar results have been obtained using a variety of other solvents and polymeric materials other than polypropylene.

The compositions of the present invention may be employed for cleaning a variety of vessels, and it will be understood that as used herein the term "vessel" refers to any object or piece of equipment from which encrusted deposits are to be cleaned. Specifically, the term "vessel" includes tanks, conduits, tubes, hoses, nozzles and similar parts of paint delivery systems, chemical processing equipment, food handling equipment and the like. The particular sequence of cleaning steps will depend upon the nature of the article being cleaned as well as the characteristics of the encrustations which are being removed.

In a typical process for the cleaning of a paint delivery system, the system is first drained of paint and the lines thereof are blown out with compressed air to remove any residual paint. At this point it is generally advantageous to remove the filters, debris screens and like items in the system. The painting system is then filled with one of the cleaning solvent compositions of the present invention and the delivery pumps thereof are activated to pass the solvent through the lines of the system. Circulation of the fluid is maintained for a time sufficient to loosen residues in the line. Generally it is sufficient to maintain circulation from 6 to 8 hours and it has been found that adequate cleaning is obtained if a minimum flow rate of 50 feet per minute is maintained through the lines. It should be noted that the solutions are generally employed at room temperature for sake of simplicity although it may be advantageous in some instances to hasten cleaning action by heating the solution. Such heating may be readily accomplished by disposing a heating unit in series with the paint lines.

After the initial circulation of cleaning solvent is completed, it has generally been found advantageous to rinse the system so as to remove traces of the cleaning composition. Such rinsing is preferably accomplished with a solvent compatible with subsequently introduced paint. In many instances rinsing will be most advantageously accomplished by utilizing a solvent similar to the vehicle of the cleaning composition, but lacking the polymeric material therein. In other instances cleaning will be found to be accomplished most efficiently by utilizing a dual stage process wherein a first charge of contaminated cleaning composition is drained from the system and a second charge of fresh composition is introduced and circulated for another period of time. Obviously, such process may be followed with a rinse step. In those instances where a dual stage process is employed the second charge of cleaning composition will usually be only very lightly contaminated and may be saved and reused as a first charge of cleaning compositions for subsequent operations. Clearly, this process may be varied in many ways depending upon the particular application. As noted previously, cleaning may be carried out at an elevated temperature; likewise, the cleaning composition may be agitated or vibrated as for example, by ultrasonic energy, to enhance scrubbing action.

Obviously, many other variations of the present invention, both in terms of compositions and methods of application may be had in light of the foregoing teaching. For example, cleaning of the external surfaces of articles may be readily accomplished by spraying the organic particulate containing compositions disclosed herein onto the surfaces of articles. Such a process is particularly advantageous for degreasing articles or for stripping paint therefrom. In a similar manner, the compositions disclosed herein may be employed in combination with scrub pads, brushes or other mechanical applicators to effect cleaning. These and other such variations are clearly within the scope of the present invention. It is to be understood that the foregoing description, discussion and examples are merely meant to illustrate particular embodiments of the invention and are not meant to be limitations upon the practice thereof. It is the following claims, including all equivalents which define the scope of the invention.

We claim:

1. A cleaning composition for removing deposits from the liens of a paint delivery system, comprising by weight:

80 to 98% a liquid vehicle including xylene, isobutyl butyrate, and dibasic ester;

2 to 20% of a polymeric material dispersed in the vehicle, said polymeric material comprising particles of no greater than 200 microns in size of a member selected from the group consisting essentially of: polypropylene, polyvinylchloride, polyethylene, polytetrafluoroethylene, copolymers thereof, and mixtures thereof, said composition further characterized in that its viscosity is similar to that of water.

2. A composition as in claim 1, wherein said particulate material has a particle size within the range of 50–150 microns.

3. A composition as in claim 1, wherein said vehicle includes water.

4. A composition as in claim 1, wherein said vehicle includes a detergent.

5. A composition as in claim 1, wherein said vehicle includes a surfactant.

6. A composition as in claim 1, wherein said vehicle is acidic.

7. A composition as in claim 1, wherein said vehicle is alkaline.

8. A composition as in claim 1, wherein said organic liquid and organic particulate are incineratable, whereby said composition may be displaced of by burning.

9. A composition as in claim 1, wherein said organic, particulate material has a low adhesion to metallic surfaces.

10. A composition as in claim 1, wherein said liquid vehicle is essentially inert to the organic, particulate material.

* * * * *